US011156413B2

(12) United States Patent
Takase

(10) Patent No.: US 11,156,413 B2
(45) Date of Patent: Oct. 26, 2021

(54) METAL PLATE BURRING METHOD

(71) Applicant: T.RAD Co., Ltd., Tokyo (JP)

(72) Inventor: Masaaki Takase, Tokyo (JP)

(73) Assignee: T.RAD CO., LTD., Tokyo (JP)

( * ) Notice: Subject to any disclaimer, the term of this patent is extended or adjusted under 35 U.S.C. 154(b) by 134 days.

(21) Appl. No.: 16/466,815

(22) PCT Filed: Dec. 20, 2017

(86) PCT No.: PCT/JP2017/047146
§ 371 (c)(1),
(2) Date: Jun. 5, 2019

(87) PCT Pub. No.: WO2018/124254
PCT Pub. Date: Jul. 5, 2018

(65) Prior Publication Data

US 2019/0301818 A1 Oct. 3, 2019

(30) Foreign Application Priority Data

Dec. 26, 2016 (JP) ..... JP2016-250562

(51) Int. Cl.
*F28F 9/04* (2006.01)
*B21D 19/08* (2006.01)

(52) U.S. Cl.
CPC ..... *F28F 9/04* (2013.01); *B21D 19/08* (2013.01)

(58) Field of Classification Search
CPC .... B21D 19/005; B21D 19/08; B21D 19/088; B21D 19/12; B21D 28/14; B21D 28/34;
(Continued)

(56) References Cited

U.S. PATENT DOCUMENTS 1,332,592 A * 3/1920 Baker ..... B21D 53/14 72/203
1,528,587 A * 3/1925 Thackray ..... B21D 19/08 72/335

(Continued)

FOREIGN PATENT DOCUMENTS

JP H01104421 * 4/1989 ..... B21D 19/08
JP 2-154992 A 6/1990

(Continued)

OTHER PUBLICATIONS

JPH01104421A MT (Year: 1989).*
JP3822958 Kanai (Sep. 20, 2006) (Year: 2006).*

*Primary Examiner* — Adam J Eiseman
*Assistant Examiner* — Fred C Hammers
(74) *Attorney, Agent, or Firm* — Norris McLaughlin, P.A.

(57) ABSTRACT

Respective gaps between a pair of vertical outer surfaces parallel to a pressing direction of a punch and inner surfaces of a cavity portion of a die facing the same, at positions at both ends in a longitudinal direction of the cross-section of the punch, are set smaller than respective gaps between outer surfaces parallel to the pressing direction of the punch and inner surfaces of the cavity portion of the die facing the same, at positions at both ends in a width direction of the cross-section. Burring height formed by pressing a punch for burring toward the cavity portion to insert the punch into the same is generally proportional to these gap values, and therefore the burring height at ends in the major axis direction becomes lower than that in the minor axis direction.

2 Claims, 8 Drawing Sheets

(58) Field of Classification Search
CPC ..... B21D 22/02; B21D 53/02; B21D 53/04; B21D 53/08; F28F 13/18; F28F 1/32; F28F 1/02; F28F 19/06; F28F 9/18; B23K 1/00
USPC ..... 72/332, 333, 334
See application file for complete search history.

(56) References Cited

U.S. PATENT DOCUMENTS 1,800,531 A * 4/1931 Hothersall ..... B21D 51/26 72/337
2,246,022 A * 6/1941 Tinnerman ..... B21D 53/36 72/335
2,383,584 A * 8/1945 Beishline ..... B21D 19/08 72/335
3,129,744 A * 4/1964 Payne ..... B21D 28/14 72/327
3,365,926 A * 1/1968 Price ..... B21D 35/00 72/283
3,682,122 A * 8/1972 Haddon ..... B21D 53/04 72/348
3,693,568 A * 9/1972 McKee ..... B21D 19/08 72/348
4,170,890 A * 10/1979 Kojima ..... B21D 19/08 72/335
4,373,369 A * 2/1983 Schey ..... B21D 19/08 72/334
4,400,965 A * 8/1983 Schey ..... B21D 19/08 29/890.043
5,159,826 A * 11/1992 Miyazawa ..... B21D 22/04 72/358
5,235,881 A * 8/1993 Sano ..... B21D 28/16 72/333
2006/0107721 A1* 5/2006 Oishi ..... B21D 28/26 72/327
2006/0175047 A1 8/2006 Hattori et al.
2007/0234776 A1* 10/2007 Shiga ..... B21D 19/088 72/325

FOREIGN PATENT DOCUMENTS

JP 8-267147 A 10/1996
JP 2006-214702 A 8/2006
JP 3822958 B2 9/2006

* cited by examiner

METAL PLATE BURRING METHOD

TECHNICAL FIELD

The present invention relates to a burring method for metal plates such as a header plate for a heat exchanger in vehicles and the like.

BACKGROUND ART

Common heat exchangers are configured by providing a core portion between an inlet side tank and an outlet side tank for fluid such as cooling water. The core portion has stacked plural flat tubes and plural fins arranged therebetween, and both end portions of each flat tube are brazed and fixed in a state of being inserted in burred flat holes formed on a header plate of each tank. Usually, a header plate, flat tube and fin are produced by machining a metal plate such as an aluminum material.

A flat hole in a header plate is usually formed by press machining. Specifically, one of surfaces of a metal plate is arranged from above so as to contact a surface of a die (fundamental tool) in which a flat cavity portion has been formed, and in this state an apical portion of a flat punch (punch tool) for burring machining is pressed toward the cavity portion from the other surface of the metal plate, to machine a burred flat hole in the metal plate.

However, when a burred flat hole is to be machined by a press machining, comparatively large stress is generated at both apical portions in a major axis direction where the curvature radius of the flat hole is small, and therefore local damage such as crack may be created with high probability in a burred portion at the apical portion. FIG. 11 shows an example in which such a crack phenomenon is generated. In the example in FIG. 11, a burring 3 having identical height is formed on the entire peripheral edge of a flat hole 2 formed by press machining in a metal plate 1, and a crack portion 4 is brought about at one of apical portions in the major axis direction thereof. When the crack portion 4 like this is generated, brazing quality between parts is not stabilized, and durability performance of a product is also not stabilized. Furthermore, inferior phenomena such as leakage of fluid from the portion may be brought about.

In Patent Literature 1, a method for solving the above-described problem is disclosed. FIG. 12 illustrates a reference view for explaining the burring method disclosed in Patent Literature 1. In this burring method, first as in FIG. 12(A), at both end portions in the major axis direction of a region in a metal plate 1 in which the flat hole 2 is formed, prepared holes 5 with a diameter smaller than thickness (wall thickness) of a flat tube are formed respectively in advance. Each prepared hole 5 is punched, as shown in FIG. 12(B), with a punch 6 for forming a small hole. Next, as shown in FIG. 12(C), a part sandwiched by both prepared holes 5 is subjected to press machining with a punch 7 for burring to machine the flat hole 2 with the burring 3.

Meanwhile, in FIG. 12(D), there is shown a state where a rim portion of a tank main body 9 is fixed to both end portions of a header plate 8 that is a metal plate 1 to form a tank 10 and an apical portion of a flat tube 11 is inserted in the flat hole 2 on which the burring 3 has been formed.

According to the method in Patent Literature 1, the metal in a portion of the metal plate 1 for which the prepared hole 5 has been formed has been removed in advance, and therefore, when press machining is performed, height of the burring 3 to be formed at both end portions in the major axis direction of the flat hole 2 is to be formed slightly lower than other portions of the burring 3 in accordance with the removed metal amount. Therefore, it is expected that stress to be brought about in the portion upon press machining decreases accordingly to some extent, and that the crack phenomenon as shown in FIG. 11 is also avoided.

CITATION LIST

Patent Literature

PTL 1: Japanese patent No. 3822958

SUMMARY OF INVENTION

Technical Problem

However, in the method in Patent Literature 1, the diameter of a prepared hole 5 is limited to a range smaller than thickness of a flat tube 11, and therefore, in a case where a flat hole 2 into which the flat tube 11 is to be inserted is large, or in a case where height of burring 3 is set to be high, height of the burring 3 at both ends in the major axis direction of the flat hole 2 becomes a little. Therefore, there is limit on the effect of avoiding crack at both end portions of the flat hole.

Consequently, the present invention provides a new burring method that has solved problems in such a conventional method for avoiding crack.

Solution to Problem

A first invention of the present inventions is a burring method on a metal plate 1, including the steps of: arranging one surface of the metal plate 1 on a surface of a die 12 having a vertical inner circumferential surface relative to a planar face of the die 12 and having a cavity portion 13 whose horizontal cross-section inner circumference horizontal to the planar face is a flat shape; and pressing a flat burring punch 7 from the other surface of the metal plate 1 toward the cavity portion 13, the burring punch 7 having a vertical outer circumferential surface relative to the planar face of the die 12, wherein:

the punch 7 has a flat cross-section parallel to the planar face; and in a state in which the punch 7 is pressed toward the cavity portion 13 with the metal plate 1 therebetween, respective gaps between a pair of vertical outer surfaces parallel to a pressing direction of the punch and inner surfaces of the cavity portion 13 of the die 12 facing the same, at positions at both ends in a longitudinal direction of the cross-section of the punch 7, are set smaller than respective gaps between outer surfaces parallel to the pressing direction of the punch and inner surfaces of the cavity portion 13 of the die 12 facing the same, at positions at both ends in a longitudinal direction of the cross-section.

A second invention of the present inventions is a burring method on a metal plate 1, including the steps of: arranging one surface of the metal plate 1 in which a preliminary flat hole 1*a* has been formed in advance on a surface of a die 12 having a vertical inner circumferential surface relative to a planar face of the die 12 and having a cavity portion 13 whose horizontal cross-section inner circumference horizontal to the planar face is a flat shape; and pressing a burring punch 7 through the preliminary flat hole 1*a* from the other surface of the metal plate 1 toward the cavity portion 13, the burring punch 7 having a vertical outer circumferential surface relative to the planar face of the die 12, wherein:

the punch 7 has a flat cross-section parallel to the planar face; and in a state in which the punch 7 is pressed toward the cavity portion 13 with the metal plate 1 therebetween, respective gaps between a pair of vertical outer surfaces and inner surfaces of the cavity portion 13 of the die 12 facing the same, at positions at both ends in a longitudinal direction of the cross-section of the punch 7, is set smaller than respective gaps between outer surfaces in a width direction of the cross-section of the punch 7 and inner surfaces of the cavity portion 13 of the die 12 facing the same.

A third invention of the present inventions is that the metal plate is a header plate for a heat exchanger.

Advantageous Effects of Invention

The first invention is that respective gaps between a pair of vertical outer surfaces parallel to a pressing direction of a punch and inner surfaces of a cavity portion of a die facing the same, at positions at both ends in a longitudinal direction of the cross-section of the punch, are set smaller than respective gaps between outer surfaces parallel to the pressing direction of the punch and inner surfaces of the cavity portion of the die facing the same, at positions at both ends in a width direction of the cross-section.

Burring height formed by pressing a punch for burring toward the cavity portion to insert the punch into the same is generally proportional to these gap values, and therefore the burring height at ends in the major axis direction becomes lower than that in the minor axis direction.

As a result, stress concentration at both ends in the longitudinal direction of the burring by press is lightened.

Meanwhile, by setting the gap to zero, the burring height at the portion can be made to zero.

Furthermore in the first invention, it is unnecessary to form in advance the prepared hole 5 in a metal plate unlike Patent Literature 1, or to form in advance a preliminary flat hole in a metal plate, the process is simple and operability is also good. Then regardless of the size of flat holes or the burring height around the peripheral edges of the same, it becomes possible to perform burring with high flexibility and a wide range of applications, and simply. Meanwhile, this first invention, in which a preliminary flat hole is not provided, is suitable for instances where a flat hole that is large to some extent is unnecessary or high burring is unnecessary.

As compared with the first invention, the second invention is different from the first invention in that a preliminary flat hole is formed in advance in a metal plate prior to perform burring.

In the second invention configured in this way, as a consequence of forming in advance a preliminary flat hole, even in an instance where a comparatively large flat hole is to be formed or in an instance where high burring is to be formed, the formation of the flat holes and burring in a metal plate can be performed smoothly and accurately.

By applying the first invention or the second invention to a tube insertion hole of a header plate for a heat exchanger, stability of brazing between a flat tube and a header plate is improved, and joining strength is increased.

DESCRIPTION OF EMBODIMENTS

Figure 1:
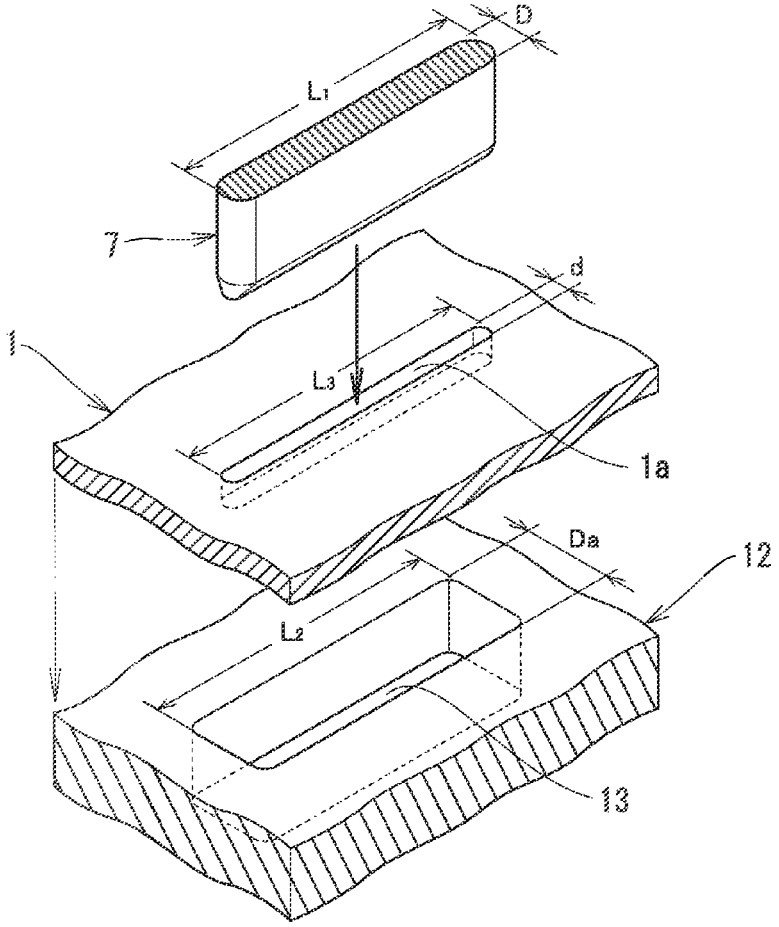
FIG. 1 illustrates a partial perspective view for explaining one example of the burring method of the present invention.

Next, on the basis of the drawings, embodiments of the present invention will be explained. FIG. 1 illustrates a partial perspective view showing one example of the burring method of the present invention, and FIG. 2 illustrates a plan view of FIG. 1.

Figure 2:
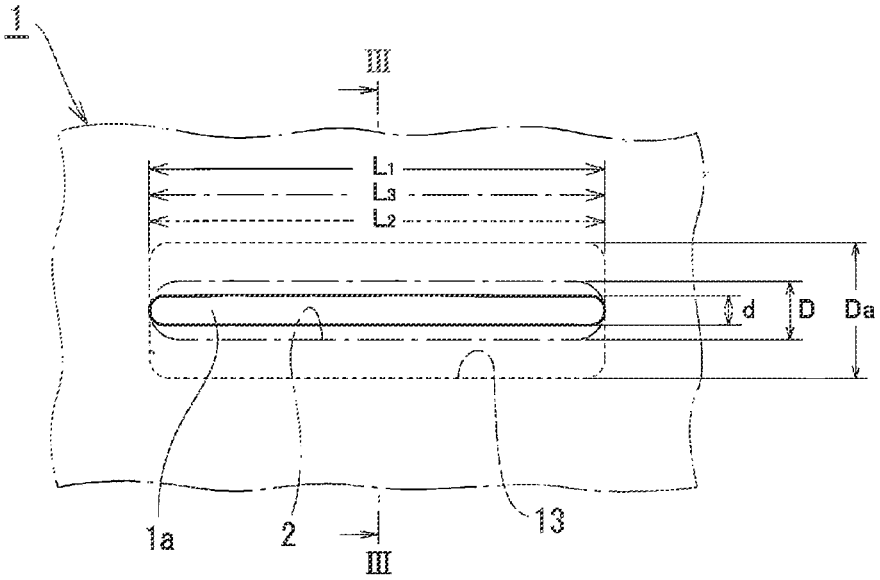
FIG. 2 illustrates a plan view of FIG. 1.

In FIGS. 1 and 2, in a metal plate 1, a preliminary flat hole 1*a*, which has a flat plan cross-section, has been formed in advance, and the dimension of the major axis thereof is shown as $L_3$, and the dimension of the minor axis is shown as d.

With regard to a punch 7 for burring, as one example, one whose cross-section orthogonal to pressing direction thereof is a race track-like shape can be employed. In other words, the cross-section thereof has a pair of parallel portions facing each other and a pair of arc portions linking between both ends thereof. The dimension along the axis in the longitudinal direction of the race track-like shape is shown as $L_1$, and the dimension in the width direction of the punch 7 is shown as D. The lower end face of the punch 7 may not be an arc shape. Note that the dimension $L_1$ of an axis along the longitudinal direction of the punch 7 is identical to the dimension $L_3$ of the major axis of the preliminary flat hole 1*a*. The dimension D of the axis along the width direction of the punch 7 is larger than the dimension d of the minor axis of the preliminary flat hole 1*a* in the metal plate 1.

A die 12 is one commonly used as a base stand for burring, the whole of which is formed in a block with a hard iron material or the like and a cavity portion 13 is formed from the upper face thereof toward the inside. The cavity portion 13 of this embodiment is a rectangular hole and four inside surfaces extend vertically from the upper face of the die 12 toward the lower side thereof. The dimension of the major axis of the cavity portion 13 is shown as $L_2$, which is the dimension identical to the dimension $L_1$ of the axis along the longitudinal direction of the punch 7 and the dimension $L_3$ of the major axis of the preliminary flat hole 1*a*. The dimension of the minor axis of the cavity portion 13 is shown as Da.

In this embodiment, the dimension $L_2$ of the major axis of the cavity portion 13 and the dimension $L_1$ of the axis along the longitudinal direction of the punch 7 are set to be identical to each other. However, as shown in FIG. 2, the dimension Da of the minor axis of the cavity portion 13 is set to a larger value than the dimension D of the axis along the width direction of the punch 7. Accordingly, the value of the gap ($L_2-L_1=0$) between the outer surface in the longitudinal direction of the punch 7 and the inner surface in the major axis direction of the cavity portion 13 is set to be smaller than the gap ($Da-D>0$) between the outer surface in the width direction of the punch 7 and the inner surface in the minor axis direction of the cavity portion 13.

Figure 3A:
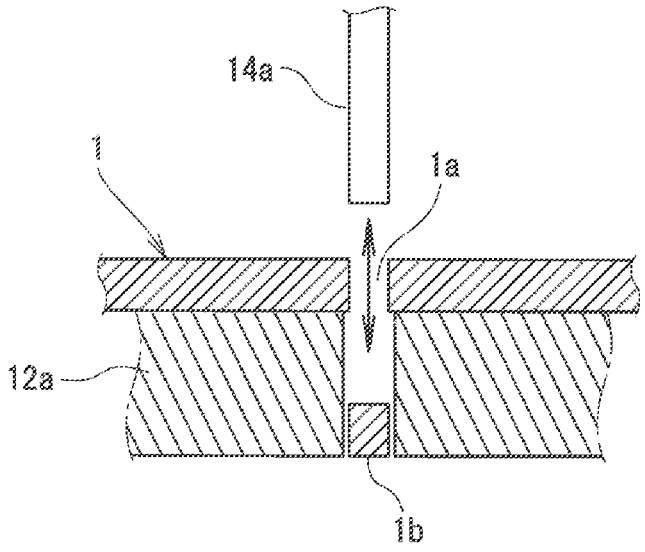
FIG. 3 illustrates a partially enlarged side cross-section view (A) in a preliminary perforating step of the metal plate 1, and a partially enlarged side cross-section view (B) showing a burring step in FIG. 1.

Next, on the basis of FIG. 3, the burring method in this embodiment shown in FIG. 1 will be explained. FIG. 3(A) is a partially enlarged side cross-section view showing a state where the metal plate 1 is being subjected to perforating machining of the preliminary flat hole 1*a*. The perforating machining of the preliminary flat hole 1*a* is performed by pressing a perforating punch 14*a* or the like in an arrow direction, in a state where one surface of the metal plate 1 is arranged on the upper face of a die 12*a*, and FIG. 3(A) shows just for reference a small piece 1*b* of the metal plate 1 having fallen in the cavity when punching has been performed.

Figure 3B:
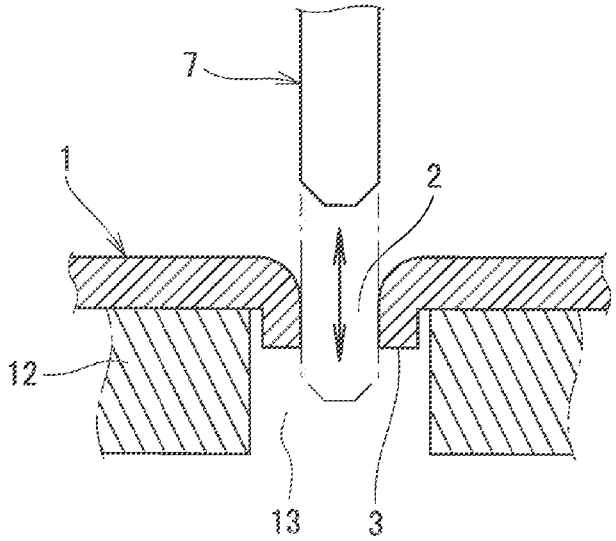

FIG. 3(B) illustrates a partially enlarged side cross-section view showing a state where burring is being performed using the punch 7 shown in FIG. 1. The punch 7 has a flat race track-like cross-section that is orthogonal to the pressing direction, and has two even side surfaces parallel to each other at both ends in the longitudinal direction thereof and in the width direction thereof. Note that lower end portions of respective side surfaces have been subjected to chamfering.

In this embodiment, the dimension $L_2$ of the major axis in the cavity portion 13 and the dimension $L_1$ along the axis in the longitudinal direction of the punch 7 are set to be identical. In other words, the gap between the outer surface in the longitudinal direction of the punch 7 and the inner surface in the major axis direction of the cavity portion 13 is substantially zero. Therefore, when the punch 7 is pushed into the cavity portion 13, there are no portions to be bent up at both ends of the major axis of the cavity portion 13 in the metal plate 1, and as a result burring is substantially not formed at the portions.

In a case where it is also necessary to form a comparatively low burring 3 at metal plate 1 portions positioned at both ends of the major axis of the cavity portion 13, the dimension $L_2$ of the major axis in the cavity portion 13 may be set to be slightly longer than the dimension $L_1$ of the axis along the longitudinal direction in the punch 7.

Figure 4:
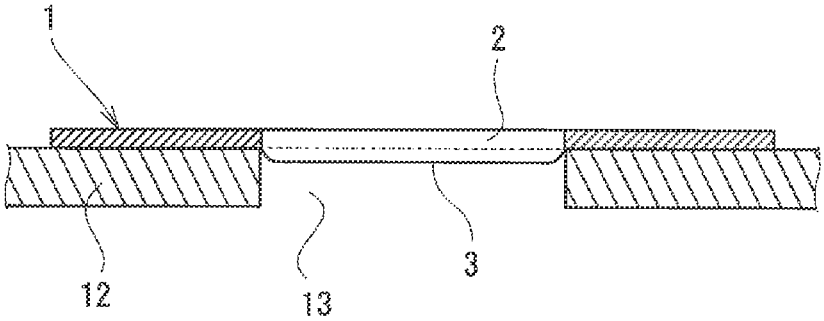
FIG. 4 illustrates a partially enlarged side cross-section view of a metal plate burred according to the present invention.

FIG. 4 illustrates a partially enlarged side cross-section view showing a state where the metal plate 1 arranged on the die 12 has been subjected to burring, which shows an example of forming the comparatively low burring 3 at metal plate 1 portions positioned at both ends of major axis of the cavity portion 13, by setting modification of the gap as described above. Meanwhile, FIG. 4 is a side cross-section view seen from the minor axis direction of the cavity portion 13, in which both ends of a high burring 3 at the portion run in a line to the arc low burring 3.

Figure 5:
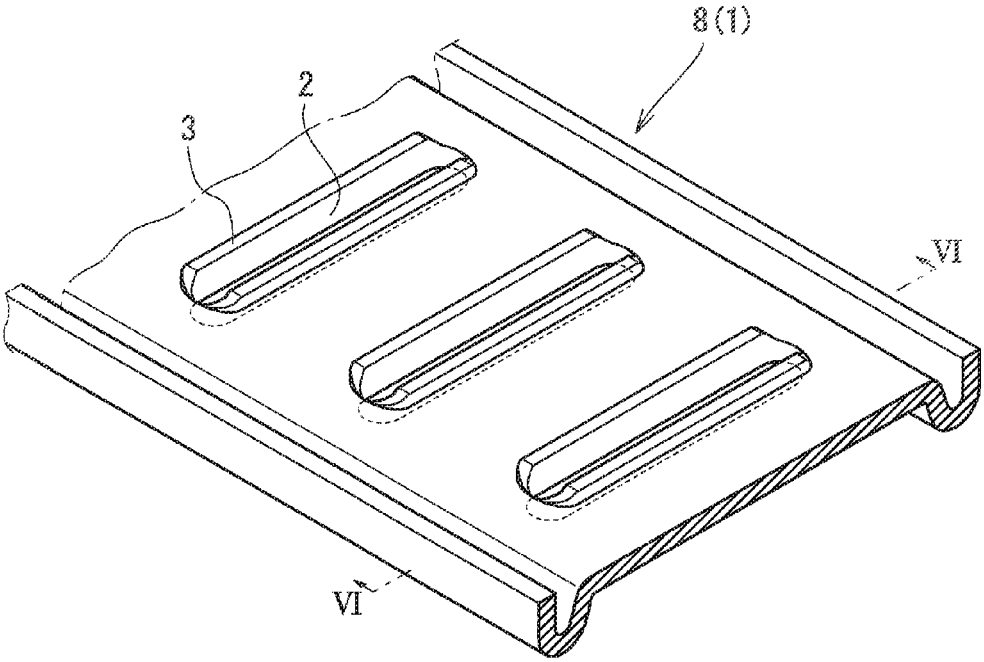
FIG. 5 illustrates a partially enlarged perspective view of a header plate burred according to the present invention.
Figure 6:
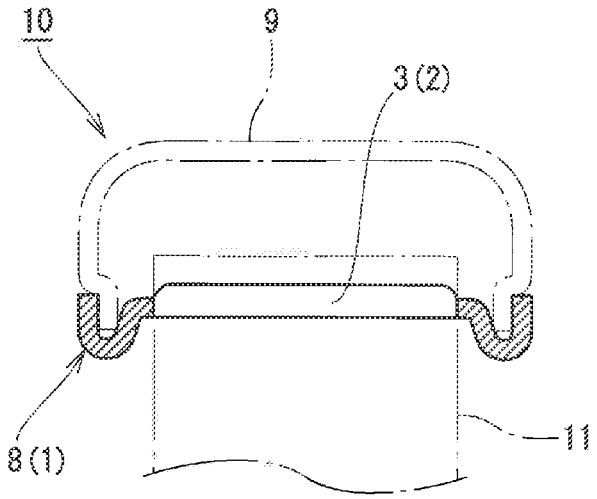
FIG. 6 illustrates a VI-VI arrow-seen cross-section view of FIG. 5.

FIG. 5 is a partially enlarged perspective view of a header plate 8 (metal plate 1) burred as in FIG. 4, and FIG. 6 is a VI-VI arrow-seen cross-section view of FIG. 5. In FIG. 6, there are shown together a state where the rim of a tank main body 9 shown by a dotted line is fixed to both ends of the header plate 8 to form a tank 10, and a state where an apex of a flat tube 11 is inserted in the flat hole 2.

Figure 7:
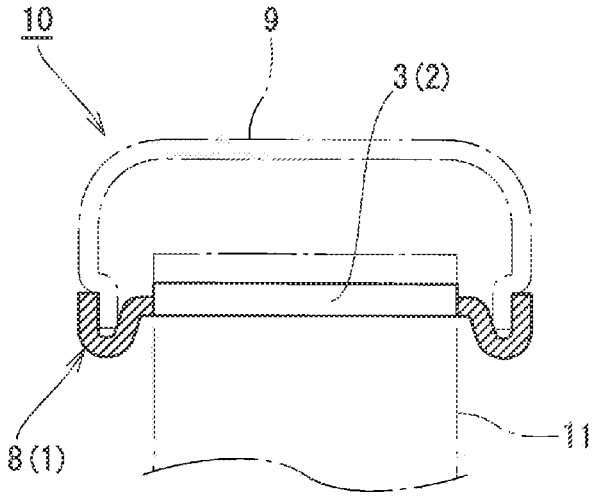
FIG. 7 illustrates a partial cross-section view of a header plate 8 different from FIG. 6, which is burred according to the present invention.

FIG. 7 is a partial cross-section view of the header plate burred in a configuration in which the horizontal cross-section shape of the punch 7 is set to an approximate rectangle, and the gap between the outer surface in the longitudinal direction of the punch 7 and the inner surface in the major axis direction of the cavity portion 13 is set substantially to zero. FIG. 7 is shown according to FIG. 6, but in FIG. 7 both ends of the high burring 3 in the minor axis direction in the metal plate 1 form vertical surfaces relative to the planar face of the metal plate 1. In this case, it is shown that any burring 3 is substantially not formed at both ends in the major axis direction of the cavity portion 13.

Figure 8:
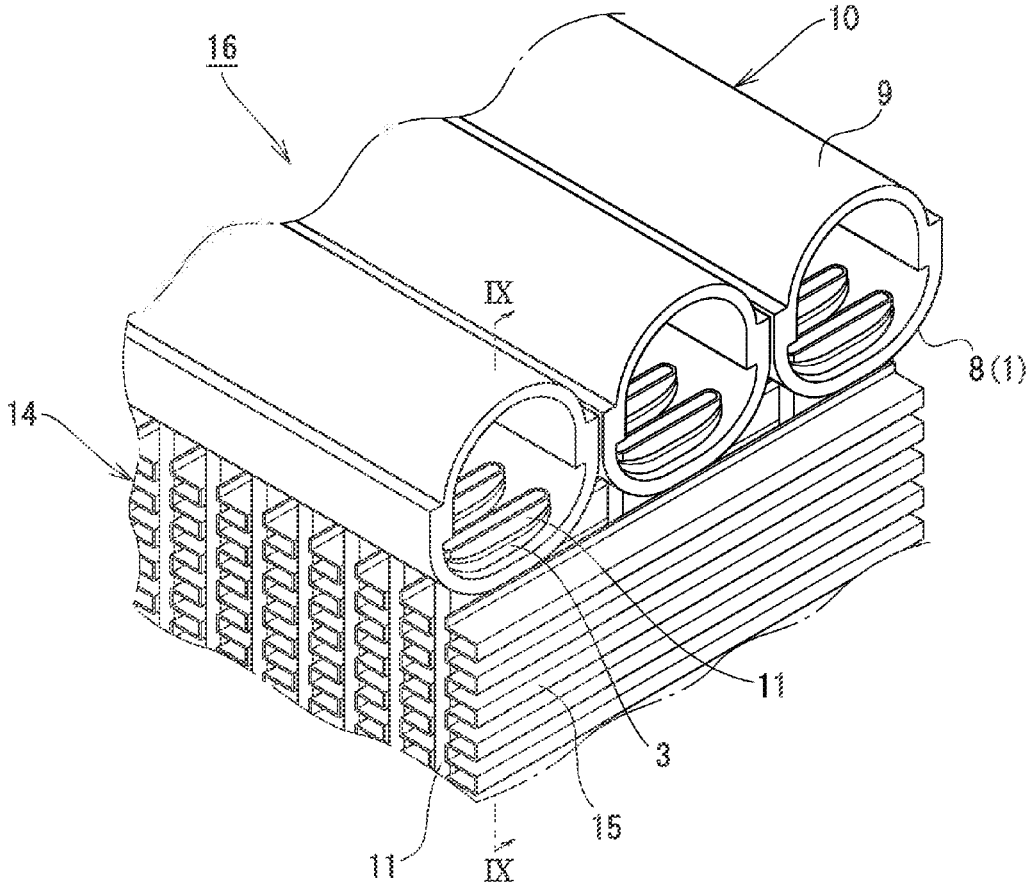
FIG. 8 illustrates a partially enlarged perspective view of a heat exchanger using a furthermore another header plate burred according to the present invention.
Figure 9:
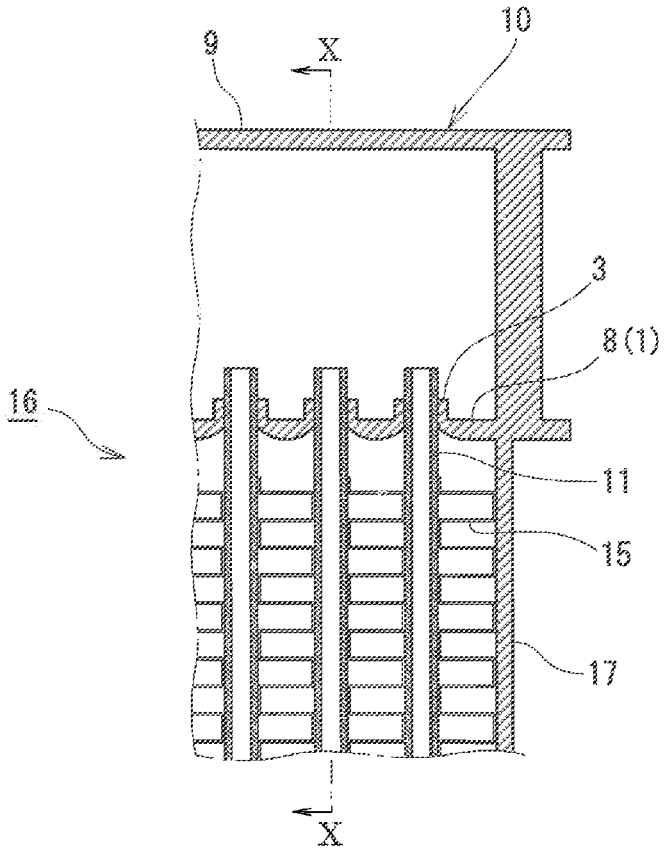
FIG. 9 illustrates a IX-IX arrow-seen cross-section view of FIG. 8.
Figure 10:
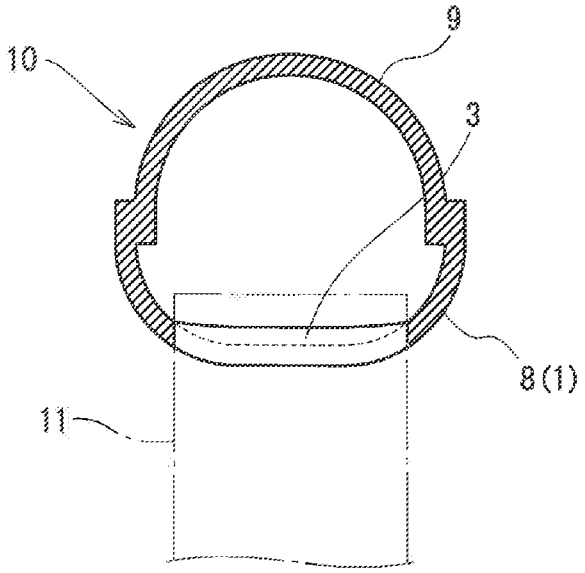
FIG. 10 illustrates a X-X arrow-seen cross-section view of FIG. 9.
Figure 11:
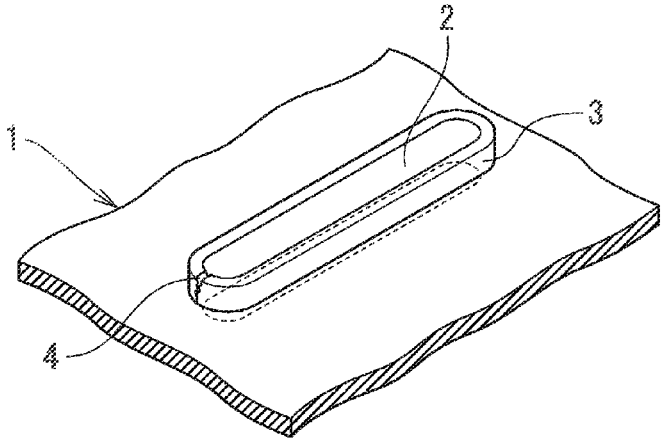
FIG. 11 illustrates a partial perspective view showing an example in which crack occurs at a burring portion.
Figure 12A:
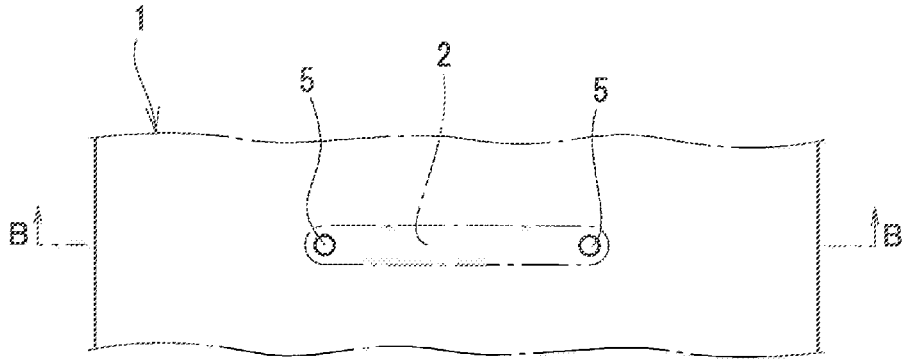
FIG. 12 illustrates a view explaining a conventional burring method.
Figure 12B:
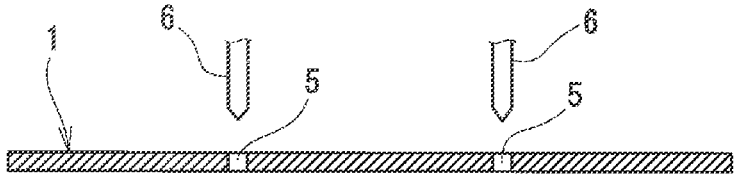
Figure 12C:
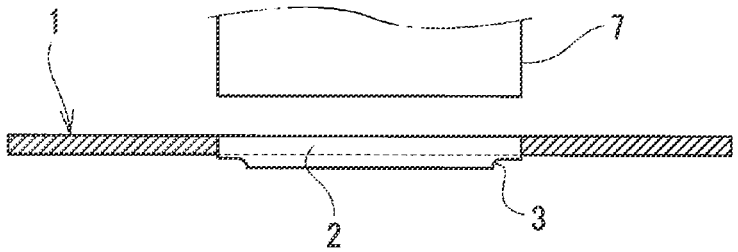
Figure 12D:
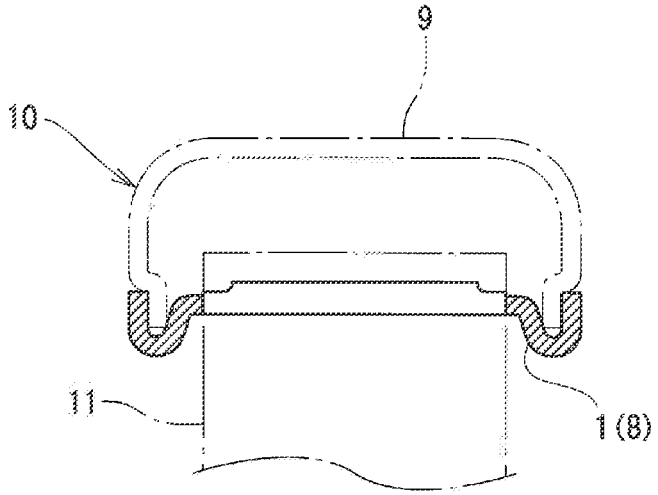

FIG. 8 illustrates a partially enlarged perspective view of a heat exchanger 16 on which the header plate 8 of another Example burred according to the present invention is mounted, FIG. 9 illustrates a IX-IX arrow-seen cross-section view of FIG. 8, and FIG. 10 is a X-X arrow-seen cross-section view of FIG. 9.

In this example, the horizontal cross-section of the header plate 8 is formed in an arc shape. To the header plate 8, a tank main body 9 having an arc horizontal cross-section is fixed to form a tank 10, and a core portion 14 is formed of stacked plural flat tubes 11 and fins 15 arranged therebetween. Further, burring is formed on this header plate 8 having an arc cross-section. Regarding the height of burring from an opening edge face, it is low at both ends thereof and is high between these.

The heat exchanger 16 is configured by these respective members.

Meanwhile, in FIG. 9, an end lid and a core support 17 fixed to one of ends of the core portion 14, which are not shown in FIG. 8, are shown just for reference.

Note that, in the above explanation, the example in which the preliminary flat hole 1*a* has been formed in advance in the metal plate 1 is explained, but it may be omitted (claim 1).

INDUSTRIAL APPLICABILITY

The present invention can be utilized for burring a metal plate such as a header plate for a heat exchanger in vehicles and construction machines.

REFERENCE SIGNS LIST

1 metal plate
1*a* preliminary flat hole
1*b* small piece
2 flat hole
3 burring
4 crack portion
5 prepared hole
6 punch
7 punch
8 header plate
9 tank main body
10 tank
11 flat tube
12 die
12*a* die
13 cavity portion
14 core portion
14*a* perforating punch

15 fin
16 heat exchanger
17 core support

The invention claimed is:

1. A burring method on a metal plate, comprising the steps of:

arranging a first surface of the metal plate on a surface of a die, the die having a cavity portion forming a vertical inner circumferential surface relative to a planar face of the die, and the cavity portion's horizontal cross-section inner circumference parallel to the planar face being a flat shape, the flat shape being oblong of length greater than width; and pressing a burring punch from a second surface of the metal plate toward the cavity portion, the second surface of the metal plate being opposite the first surface of the metal plate, the burring punch having an oblong horizontal cross-section of length greater than width, and the burring punch having a vertical outer circumferential surface relative to the planar face of the die, wherein:

the punch has a flat cross-section parallel to the planar face; and in a state in which the burring punch is pressed toward the cavity portion of the die with the metal plate therebetween, a gap between the vertical outer circumferential surface of the burring punch parallel to a pressing direction of the burring punch and the vertical inner circumferential surface of the cavity portion of the die facing the same is set smaller at both ends in a longitudinal direction of the horizontal cross-section of the burring punch than between said both ends whereby a burring of lesser height at said both ends than between said both ends is formed.

2. A burring method on a metal plate, comprising the steps of:

arranging a first surface of the metal plate in which a preliminary flat hole has been formed in advance on a surface of a die, the preliminary flat hole having an oblong horizontal cross-section of length greater than width, the die having a cavity portion forming a vertical inner circumferential surface relative to a planar face of the die, and the cavity portion's horizontal cross-section inner circumference parallel to the planar face being a flat shape, the flat shape being oblong of length greater than width; and pressing a burring punch through the preliminary flat hole from a second surface of the metal plate toward the cavity portion, the second surface of the metal plate being opposite the first surface of the metal plate, the burring punch having an oblong horizontal cross-section of length greater than width, and the burring punch having a vertical outer circumferential surface relative to the planar face of the die, wherein:

the punch has a flat cross-section parallel to the planar face; and in a state in which the burring punch is pressed toward the cavity portion of the die with the metal plate therebetween, a gap between the vertical outer circumferential surface of the burring punch and the vertical inner circumferential surface of the cavity portion of the die facing the same is set smaller at both ends in a longitudinal direction of the horizontal cross-section of the burring punch than between said both ends whereby a burring of lesser height at said both ends than between said both ends is formed.

* * * * *